US007520092B2

(12) United States Patent
Showers et al.

(10) Patent No.: US 7,520,092 B2
(45) Date of Patent: Apr. 21, 2009

(54) RESIN DECK BOARD WITH WATER DRAINAGE TOP SURFACE

(76) Inventors: Ray Showers, 1212 Walton St., Philipsburg, PA (US) 16866; John Showers, 1212 Walton St., Philipsburg, PA (US) 16866

( * ) Notice: Subject to any disclaimer, the term of this patent is extended or adjusted under 35 U.S.C. 154(b) by 592 days.

(21) Appl. No.: 10/801,887

(22) Filed: Mar. 16, 2004

(65) Prior Publication Data

US 2005/0204662 A1 Sep. 22, 2005

(51) Int. Cl.
*E04B 5/02* (2006.01)
*E04C 3/00* (2006.01)

(52) U.S. Cl. ..... 52/177; 52/579; 52/483.1

(58) Field of Classification Search ..... 52/592.1, 52/588.1, 650.3, 177, 100, 731.3, 730.4, 52/732.2, 591.1, 480, 483.1, 403.1, 180, 52/181, 579, 574, 591.4, 506.1, 536, 732.3; D25/125; 405/218, 219

See application file for complete search history.

(56) References Cited

U.S. PATENT DOCUMENTS 1,632,395 A * 6/1927 Fellows ..... 404/32
3,172,343 A * 3/1965 Jacobs ..... 428/600
3,172,508 A * 3/1965 Doering et al. ..... 52/579
4,063,395 A * 12/1977 Stewart et al. ..... 52/309.5
4,266,381 A * 5/1981 Deller ..... 52/177
4,584,221 A * 4/1986 Kung ..... 428/44
4,907,387 A * 3/1990 Turnbull ..... 52/177
5,009,045 A * 4/1991 Yoder ..... 52/177
5,050,361 A * 9/1991 Hallsten ..... 52/581
5,050,362 A * 9/1991 Tal et al. ..... 52/588.1
D366,943 S * 2/1996 Sheehy ..... D25/138
5,553,427 A * 9/1996 Andres ..... 52/177
5,613,339 A * 3/1997 Pollock ..... 52/731.1
5,617,677 A * 4/1997 Hallsten ..... 52/3
5,647,184 A * 7/1997 Davis ..... 52/592.1
5,758,467 A * 6/1998 Snear et al. ..... 52/592.1
5,802,791 A * 9/1998 Kuntz ..... 52/394
5,816,010 A * 10/1998 Conn ..... 52/588.1
5,819,491 A * 10/1998 Davis ..... 52/592.1
5,983,584 A * 11/1999 Staten et al. ..... 52/309.8
D431,658 S * 10/2000 Gregori ..... D25/122
6,199,340 B1 * 3/2001 Davis ..... 52/592.1
D451,612 S * 12/2001 Thibault et al. ..... D25/119
6,324,796 B1 * 12/2001 Heath ..... 52/177
6,336,300 B1 * 1/2002 Babucke ..... 52/396.04
6,637,163 B2 * 10/2003 Thibault et al. ..... 52/177
6,739,106 B2 * 5/2004 Curatolo ..... 52/592.1
D492,797 S * 7/2004 Simko et al. ..... D25/125
6,895,881 B1 * 5/2005 Whitaker ..... 114/85
6,918,221 B2 * 7/2005 Williams ..... 52/592.1
6,986,934 B2 * 1/2006 Chen et al. ..... 428/195.1
7,021,012 B2 * 4/2006 Zeng et al. ..... 52/177

(Continued)

*Primary Examiner*—Richard E Chilcot, Jr.
*Assistant Examiner*—Chi Q Nguyen
(74) *Attorney, Agent, or Firm*—Cook Alex Ltd.

(57) ABSTRACT

A resin deck board has a top surface with a plurality of water drainage channels spaced from one another extending axially in the top surface of the board. The top surface of the board also includes a plurality of feed channels which are angled relative to and which intersect with the drainage channels. The drainage channels penetrate to a depth at least as great as that of the feed channels into the top surface of the board to promote water from the feed channels to drain in to the drainage channels which then carry the water off of the top surface of the deck.

6 Claims, 5 Drawing Sheets

U.S. PATENT DOCUMENTS 7,047,697 B1 * 5/2006 Heath ..... 52/177
D523,970 S * 6/2006 Lapp et al. ..... D25/138
7,299,592 B2 * 11/2007 Moller, Jr. ..... 52/180

* cited by examiner 1A
1
40
41
43
45
55
57
35
13
15
19
6a
5a
5
21
9a

RESIN DECK BOARD WITH WATER DRAINAGE TOP SURFACE

FIELD OF THE INVENTION

The present invention relates to a vinyl deck board having a top surface designed to promote drainage of moisture from the top surface of the deck board.

BACKGROUND OF THE INVENTION

Resin materials and in particular polyvinyl chloride materials are finding more and more use as building construction materials. PVC is often used in making building windows and doors. More recently, PVC has been used in building outdoor deck structures. When PVC is used to make a deck board the PVC material has many benefits over conventional wood materials. The PVC is very durable, is low maintenance, and can be made accurately at great lengths in an extrusion process. As a further benefit it is known to manufacture PVC deck boards with their own interlocks which substantially enhance the ease with which an entire deck surface can be built. The same cannot be said of a conventional wooden plank used in building a wooden deck structure.

One problem that is however encountered when building a deck using PVC boards is that the deck can become very slippery under wet conditions. It has been known to provide an embossment of that surface to provide traction but this still does not totally eliminate the slippage problem.

SUMMARY OF THE PRESENT INVENTION

The present invention provides a resin deck board used in combination with other like resin deck boards for building an outdoor deck surface. The deck board of the present invention has a top surface provided with a water drainage channel extending axially of the board and at least one feed channel at an angle to and intersecting with the drainage channel. The drainage channel is cut into the deck surface to a depth equal to or greater than the feed channel to enhance flow of water into the drainage channel and to inhibit the backflow of water from the drainage channel into the feed channel.

BRIEF DESCRIPTION OF THE DRAWINGS

The above as well as other advantages and features of the present invention will be described in greater detail according to the preferred embodiments of the present invention in which.

DETAILED DESCRIPTION ACCORDING TO THE PREFERRED EMBODIMENTS OF THE PRESENT INVENTION IN WHICH

Figure 1:
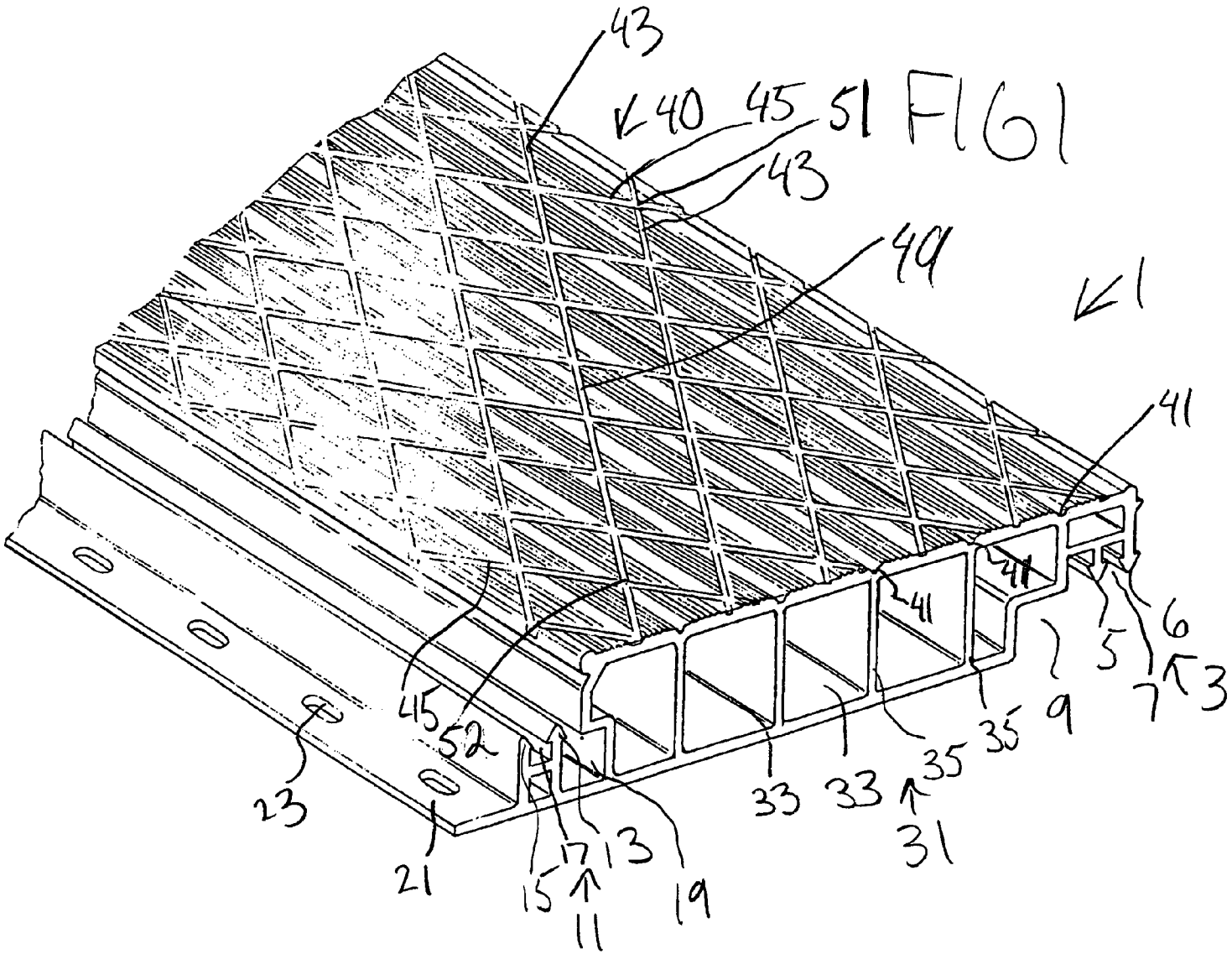
FIG. 1 is a perspective view looking down on to a vinyl deck board with a moisture drainage top surface according to a preferred embodiment of the present invention.
Figure 2:
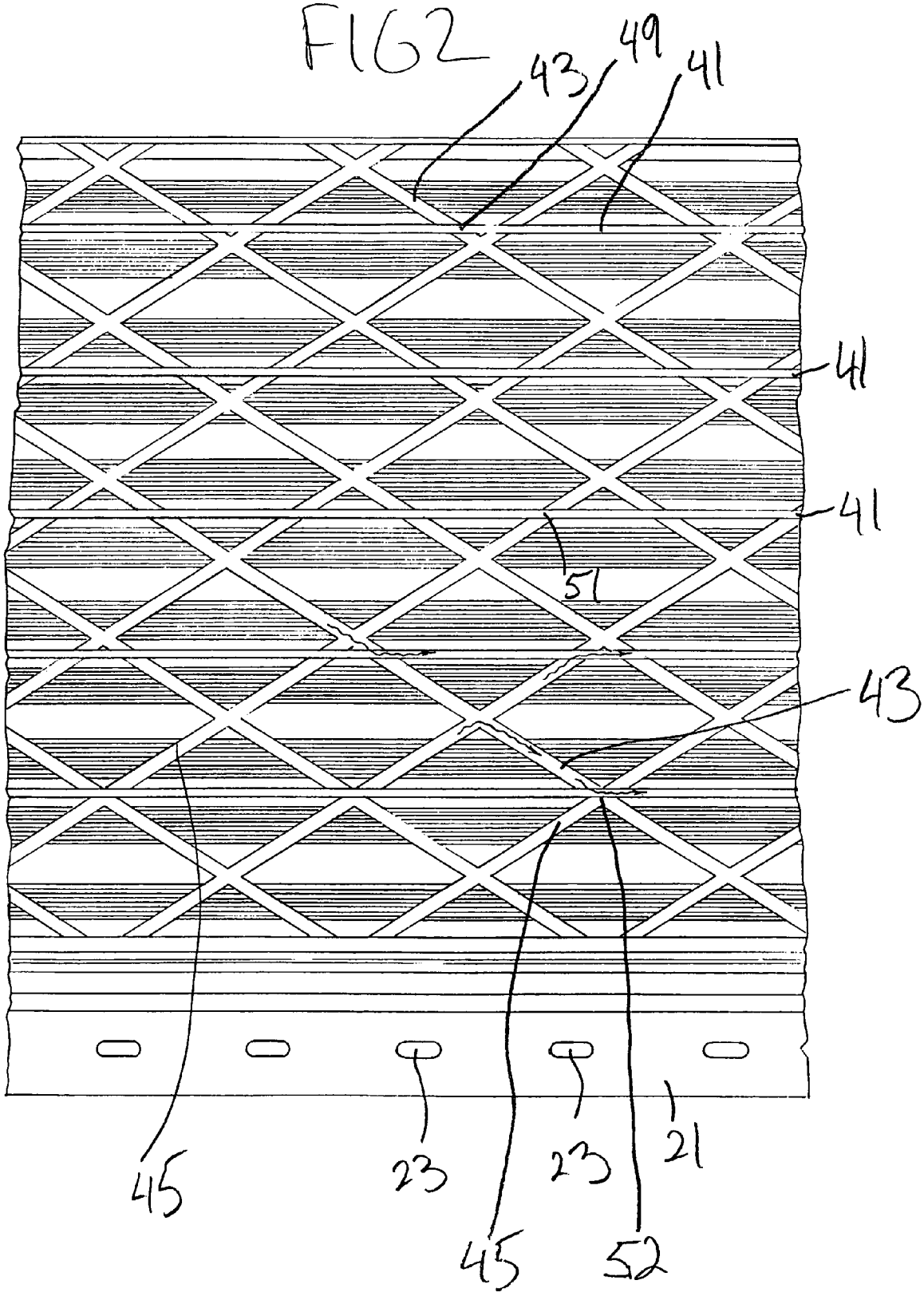
FIG. 2 is a plan view of the deck board of FIG. 1.

FIG. 1 shows a deck board generally indicated at 1. This deck board in its preferred form has a resin, preferably PVC, construction. It is made as one piece in an extrusion process. At the time of initial manufacture deck board 1 comes from a single endless extrusion which is then cut to a desired length. As a preferred size the deck board may for example be 6 inches across and have a length of for example 10 to 15 feet. These are obviously only representative dimensions and deck board 1 could be manufactured in any desired width and length dimensions.

Deck board 1 is has a first side edge generally indicated at 3 and a second side edge generally indicated at 11. Both of these side edges include interlock features which allow deck board 1 to be edge to edge connected with other like deck boards.

More specifically, side edge 3 includes a pair of downwardly extending barbs 5 and 6 separated by a gap 7. A recessed region 9 is located inwardly of barb 5 within the main body portion of the deck board.

Side edge region 11 comprises a barb 13 and a hook shaped locking element 15. Gap 17 is provided between barb 13 and element 15. Located inwardly of barb 13 is a channel 19. Provided to the outside of element 15 is a flange 21. This flange includes elongated openings 23.

Figures 3, 4:
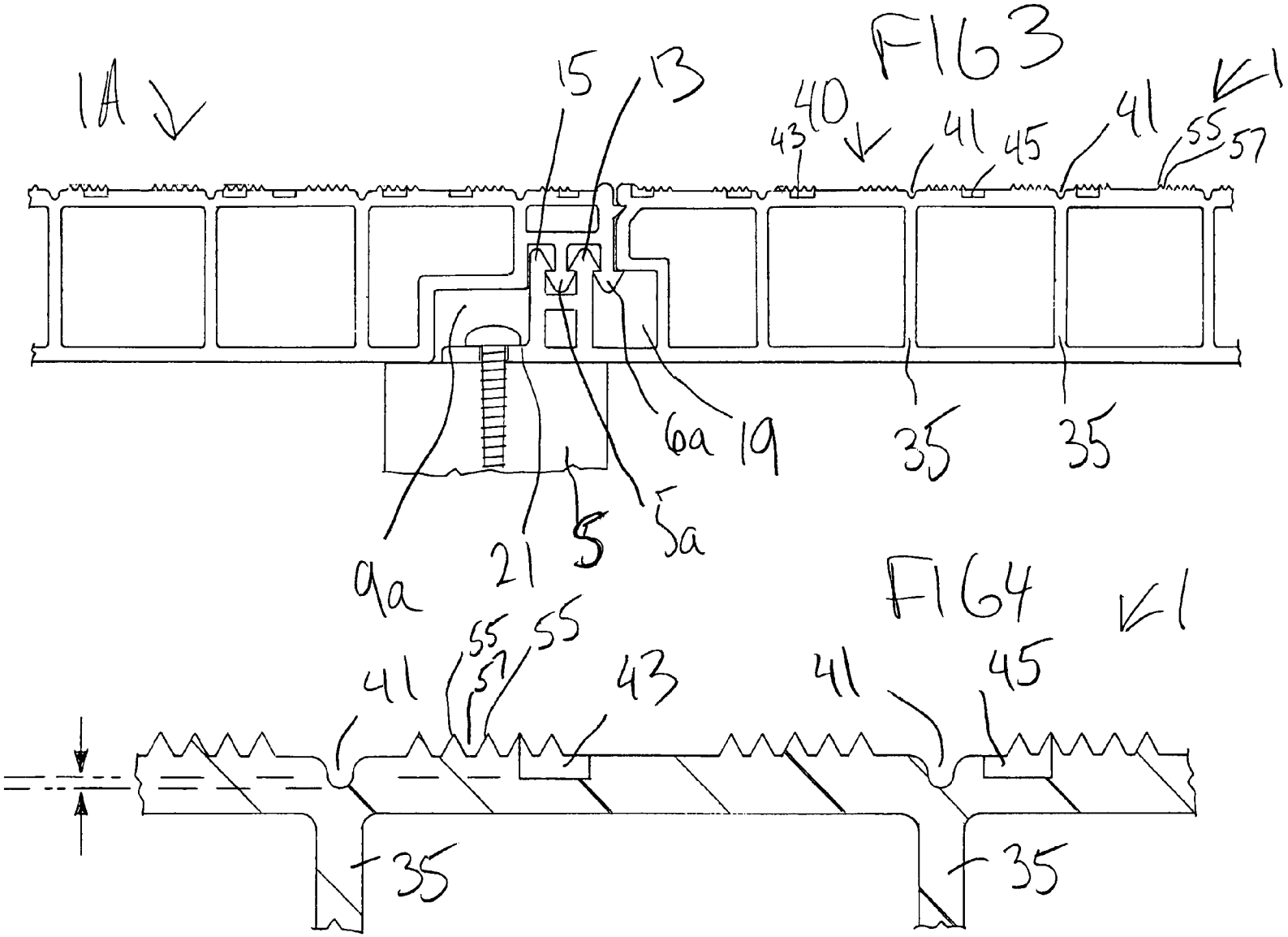
FIG. 3 is a sectional view through the deck board of FIG. 2 when connected at one outside edge of the deck board to a like deck board.
FIG. 4 is an enlarged sectional view through the top surface of the deck board of FIG. 1.

In looking at FIG. 3 of the drawings it will be seen that when deck board 1 connects with a like deck board 1*a* the barb 13 and locking element 15 of deck board 1 snap connect with barbs 5*a* and 6*a* of deck board 1*a*. Furthermore, barb 6*a* of deck board 1*a* snaps down through the mouth of channel 19 of deck board 1 to effectively close the channel. This channel then becomes a water drainage channel at the interlock connection between adjacent boards.

Before board 1 is snap connected with board 1*a* flange 21 of board 1 is located over a supporting stringer S. Screw nails 22 are then fitted down through the openings 23 in flange 21 to secure board 1 to the stringer. The connecting part of board 1*a* is then snapped down onto connecting region 11 of board 1. Note that the recessed area 9*a* on board 1*a* which is identical to recess 9 on board 1 ensures that the flange 21 of board 1 and the screw nails fitted through the flange do not interfere with the connecting of boards 1 and 1*a* to one another. Also to be noted is that due to the elongated shaping of openings 23 board 1 can be shifted lengthwise relative to the stringer for board adjustment purposes. This allows the ends of all of the boards to be aligned with one another when building the deck.

Figure 6:
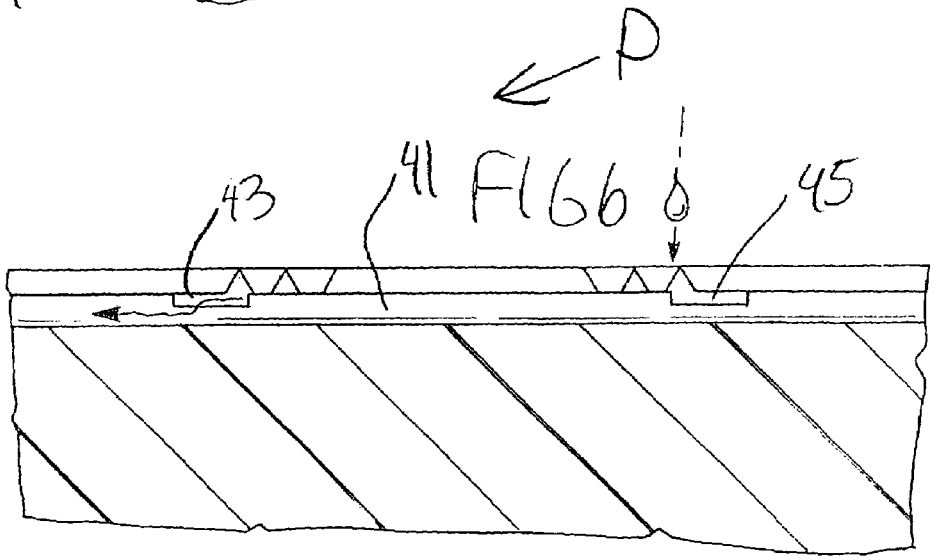
FIG. 6 is an enlarged sectional view through the top surface area of FIG. 5.
Figure 7:
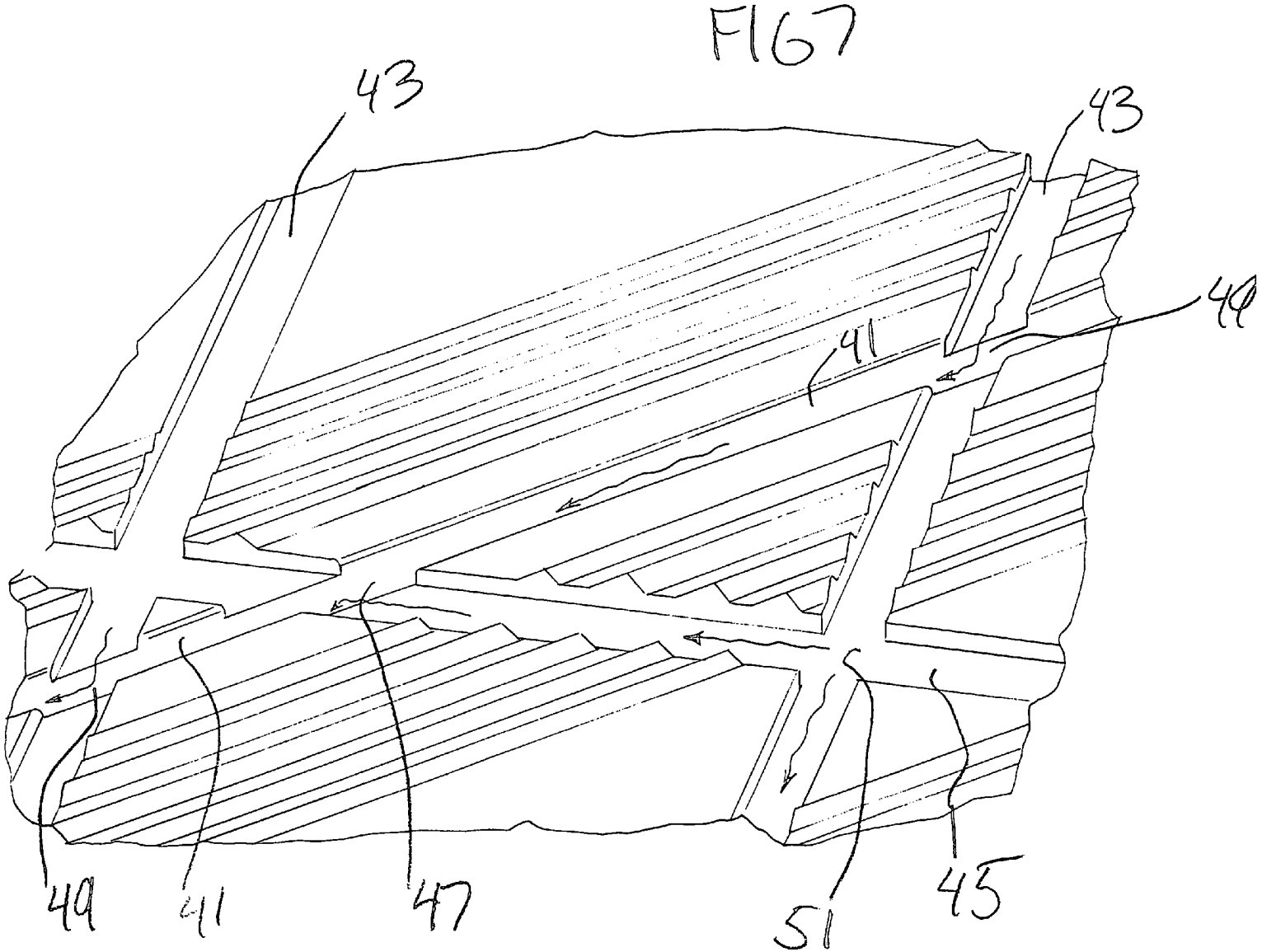
FIG. 7 is a further enlarged perspective view of a top surface area of the deck board of FIG. 1 showing the flow of moisture at that surface area.

For purposes to be described later in detail the deck when built will have a very slight pitch P along the length of the boards in the deck. See FIG. 6. This provides drainage of water from the deck's surface due to the provision of the top surfacing of each of the boards made in accordance with the present invention.

More specifically, board 1 like every other board in the deck has a top surface generally indicated at 40. This top surface during the extrusion process is formed with a plurality of axially extending water drainage channels 41. These water drainage channels are parallel to and spaced from one another across the width of the board. Each of the drainage channels extends the full length of the board.

As best seen in FIG. 4 of the drawings drainage channels 41 have a downwardly tapering configuration into the top surface of the board. This promotes the gathering of water in and the flowing of that water along each of the drainage channels.

The drainage channels are extremely important in that water falling onto the deck surface will enter the drainage channels and due to the slight pitch of the deck flow off of the deck surface through the drainage channels. This substantially helps in reducing potential slippage on the deck surface.

To further assist in adding to traction, the top surface of the deck is also provided with a plurality of raised ribs 55. These ribs as shown in the drawings are provided in groupings which like the drainage channels extend lengthwise axially of the board. A group of these ribs are provided to each side of each drainage channel. Each of the rib groupings also includes troughs 57 between the ribs 55. These troughs although not penetrating into the surface of deck also act to a certain extent as drainage channels between each of the ribs. The ribs are built to a height such that other than in extremely wet conditions any water potentially sitting on the surface of the deck is below the upper surface of the ribs.

Another feature of the invention which is seen in both FIGS. 1 and 3 of the drawings is that the interior construction 31 of deck board 1 comprises a series of hollow chambers 33 separated by internal walls 35 spanning the top and bottom surfaces of the deck board. This open construction keeps each deck board relatively light in weight, makes each deck board relatively inexpensive from a material stand point and provides air circulation through the deck board to maintain the deck board relatively cool to the touch even under hot weather conditions.

In order to maintain the integrity of the deck board each of the drainage channels 41 cuts into the top surface of the deck board directly above one of the interior board walls. This eliminates the possibility of the top surface of the deck board cracking along its length at each of the drainage channels as might be the case if the drainage channels were located centrally over the hollow chambers in the deck board.

A further key feature of the present invention relates to the provision of feed channels in the top surface of the deck board. These feed channels indicated at 43 and 45 do not extend axially of the board. In contrast, they are angled along the length of the board relative to drainage channels 41. As such, each of the feed channels intersects at an angle to the drainage channels. A lot of the feed channels i.e., those towards the center of the board intersect with all of the drainage channels. The feed channels located more towards the end of the top surface of the deck board are shorter because they do not extend across the full surface of the board. As such these shorter bead channels only catch some of the drainage channels.

Feed channels 43 extend in a first direction across the top surface of the deck board preferably at 45 degrees to the drainage channels 41. Drainage channels 41 which also extend at a preferred 45 degree angle to the longitudinal axis of the board are in a different direction i.e., 90 degrees to channel 43. This creates both a functional and esthetically pleasing diamond pattern on the top surface of the deck board.

As can also be seen in the drawings feed channels 43 intersect as indicated at 49 with drainage channels 41. Feed channels 45 intersect at 47 with drainage channels 41.

There are also some locations 51 where feed channels 43 and 45 intersect with one another. There are further locations 52 where all three of the channels meet with one another.

As will be seen in the drawings feed channels 43 and 45 intersect with the troughs between the raised ribs on the deck surface. As such, water flowing in these troughs will feed into the feed channels to be carried to the drainage channels.

Even though the feed channels are angled across the board surface the pitch on the board over its length still causes water picked up in the feed channels to flow at an angle along the length of the board. Therefore, water, which enters any one of the feed channels, will at some point drain in to one or more of the drainage channels. As will be appreciated from the description above, the provision of lengthwise running drainage channels and the provision of crisscrossing feed channels on the board surface ensures that almost the entirety of the upper surface of the board clears of water relatively quickly.

Figure 5:
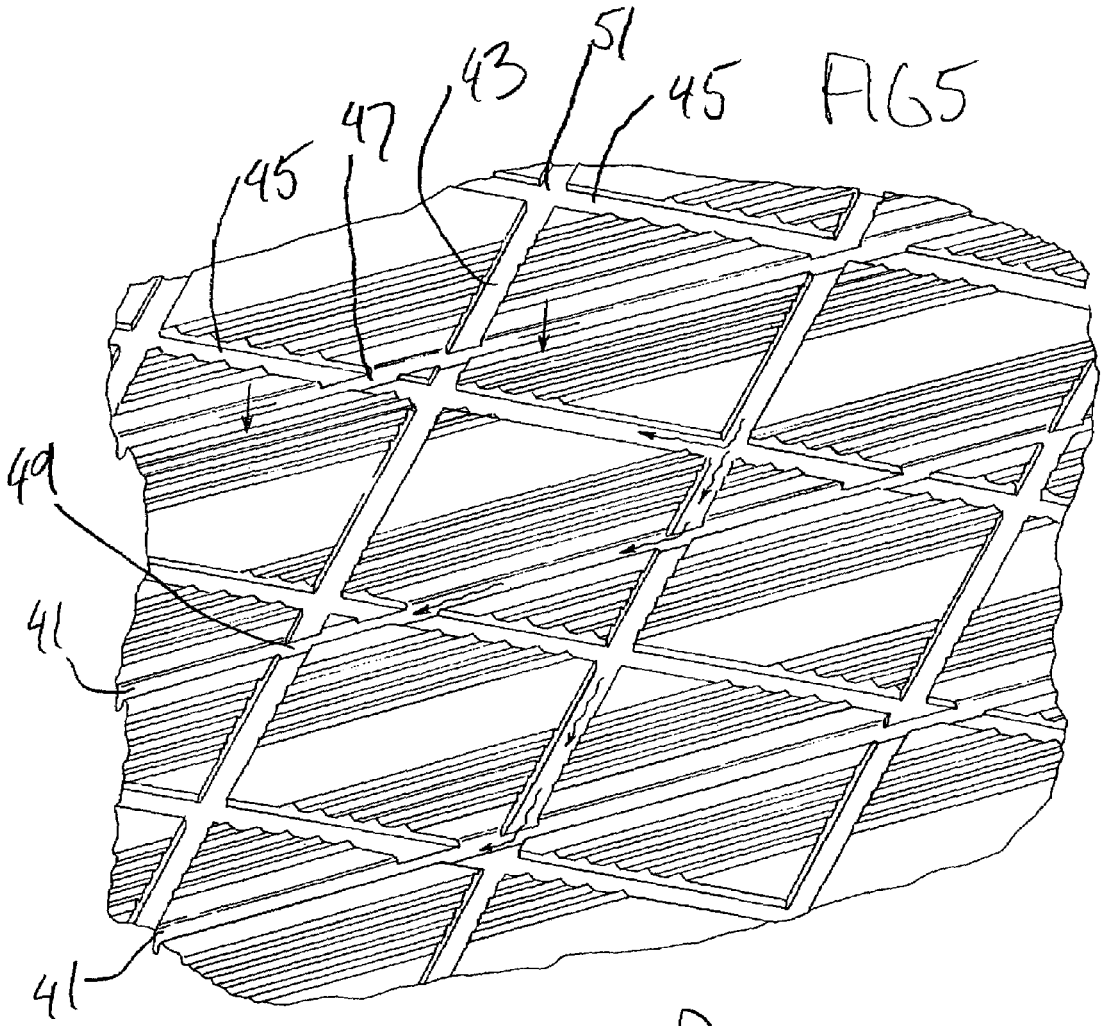
FIG. 5 is a perspective view looking down on an area of the top surface of the deck board of FIG. 1.

An important feature of the present invention is that the drainage channels 41 penetrate to a depth at least as great as that of any one of the feed channels 43 and 45. The feed channels, which as best seen in FIG. 5 of the drawings have a relatively wide shallow configuration with a flat base, may in fact be shallower than the drainage channels in the board surface. This is the case in the embodiment shown and it enhances the feeding of water from the feed channels in to the drainage channels. The drainage channels, as noted above, are shaped to promote fast flow off of the deck surface. As a result of the drainage channels always being at least as deep as and possibly deeper than the feed channels there is very little likelihood of water once in the drainage channels feeding back in to the feed channels. As such, most of the water on the top surface of the board will take the fastest and straightest route flowing directly axially of the board off of its top surface via the drainage channels 41.

Although various preferred embodiments of the present invention have been described in detail, it will be appreciated by those skilled in the art that variations may be made without departing from the spirit of the invention or the scope of the appended claims.

The embodiments of the invention in which an exclusive property or privilege is claimed are defined as follows:

1. A plastic panel assembly formed by at least first and second plastic boards secured at an interlocked joint of said first and second boards, each of said boards having a construction comprising a main body portion with a top surface, a bottom surface, a first edge region and a second edge region, said first edge region having a top surface which is a continuation of the top surface of the main body portion and also having a first locking part, said second edge region having a bottom surface which is a continuation of the bottom surface of the main body portion and also having a second locking part, said interlocked joint being formed by engagement of said first locking part of said first edge region of the first board with said second locking part of said second edge region of said second board, said assembly including both a moisture drainage channel and a mechanical fastener receiving surface which are separated from one another at said interlocked joint, said top surface of each of said first and second boards having a plurality of water drainage channels spaced from one another extending axially of said first and second boards in said top surface, said top surface also including a plurality of feed channels which are angled relative to and which intersect with said drainage channels penetrating to a depth at least as great as that of said feed channels into said top surface of said first and second boards, at least some of said feed channels extend from side to side across said first and second boards, at least some of said feed channels intersect with all of said drainage channels, said feed channels include a set of first feed channels extending in a first direction across said top surface of said first and second boards and a second set of feed channels extending in a second direction across said top surface of said first and second boards, at least some of said first feed channels intersecting with at least some of said second feed channels in said to surface of said first and second boards said first and second feed channels form a diamond pattern in said to surface of said first and second boards, and said first and second boards includes a plurality of raised grip ribs extending axially of said first and second boards between said drainage channels.

2. A plastic panel assembly as claimed in claim 1 wherein said fastener receiving surface is formed with said second edge region of said second board, said moisture drainage channel and said fastener receiving surface being located to opposite sides of said interlocked joint separated from one another by said first locking part of said first edge region and said second locking part of said second edge region of said first and second boards respectively.

3. A plastic panel assembly as claimed in claim 2 wherein said fastener receiver surface comprises a projecting fin having openings there through at regular spaced intervals along said fin.

4. A plastic panel assembly as claimed in claim 3 wherein said opening in said fin have an elongated oval shape.

5. A plastic panel assembly as claimed in claim 1 wherein said moisture drainage channel has a channel base wall which is formed by said bottom surface of said second edge region of said second board.

6. A plastic panel assembly as claimed in claim 5 wherein, said fastener receiving surface also being formed by said bottom surface of said second edge region, said channel base and said fastener receiving surface being separated from one another by an upward projection from said bottom surface of said second edge region.

* * * * *